US010537862B2

(12) United States Patent
Taher

(10) Patent No.: US 10,537,862 B2
(45) Date of Patent: Jan. 21, 2020

(54) VALVE-LESS MIXING METHOD AND MIXING DEVICE

(71) Applicants: IMEC VZW, Leuven (BE); Katholieke Universiteit Leuven, KU LEUVEN R&D, Leuven (BE)

(72) Inventor: Ahmed Taher, Leuven (BE)

(73) Assignee: IMEC VZW, Leuven (BE)

( * ) Notice: Subject to any disclaimer, the term of this patent is extended or adjusted under 35 U.S.C. 154(b) by 6 days.

(21) Appl. No.: 15/740,257

(22) PCT Filed: Jun. 28, 2016

(86) PCT No.: PCT/EP2016/065065
§ 371 (c)(1),
(2) Date: Dec. 27, 2017

(87) PCT Pub. No.: WO2017/001436
PCT Pub. Date: Jan. 5, 2017

(65) Prior Publication Data

US 2018/0311627 A1 Nov. 1, 2018

(30) Foreign Application Priority Data

Jun. 29, 2015 (EP) ..... 15174301

(51) Int. Cl.
*F15C 1/02* (2006.01)
*B01F 13/00* (2006.01)
*B01F 5/06* (2006.01)

(52) U.S. Cl.
CPC ..... *B01F 13/0083* (2013.01); *B01F 5/0647* (2013.01)

(58) Field of Classification Search
CPC ..... B01F 13/0083; B01F 5/0647
(Continued)

(56) References Cited

U.S. PATENT DOCUMENTS 4,963,498 A * 10/1990 Hillman ..... B01F 5/0618 356/28
5,726,404 A * 3/1998 Brody ..... B01L 3/502738 137/261

(Continued)

OTHER PUBLICATIONS

PCT International Search Report and Written Opinion, PCT International Application No. PCT/EP2016/065065, dated Oct. 12, 2016, 11 pages.

*Primary Examiner* — Minh Q Le
(74) *Attorney, Agent, or Firm* — McDonnell Boehnen Hulbert & Berghoff LLP

(57) ABSTRACT

A fluidic device for mixing a reagent fluid with a fluid sample comprises a supply channel having a reagent inlet, a sample inlet and a first reagent storage, coupled to the supply channel; a mixer for mixing the reagent with the fluid sample, having a mixer inlet coupled to the supply channel at a position in between the sample inlet and the first reagent storage; In a first stage, when the reagent fluid is supplied in the reagent inlet, the reagent is provided in the supply channel and the first reagent storage, and such that the reagent is thereafter stationed in the supply channel and the first reagent storage until a fluid sample is provided in the sample inlet. When the fluid sample is supplied in the sample inlet, the supplied fluid sample and the stationed reagent flows into the mixer thereby mixing both fluids.

17 Claims, 5 Drawing Sheets

(58) Field of Classification Search
USPC ..... 137/833, 7, 561 A, 896; 251/127
See application file for complete search history.

(56) References Cited

U.S. PATENT DOCUMENTS 6,068,752 A * 5/2000 Dubrow ..... B01L 3/50273 204/450
6,213,151 B1 * 4/2001 Jacobson ..... B01L 3/502 137/827
6,296,020 B1 * 10/2001 McNeely ..... B01F 5/0403 137/806
7,101,467 B2 * 9/2006 Spaid ..... B01F 13/0076 204/451
7,134,453 B2 * 11/2006 Peters ..... B01L 3/502738 137/806
7,338,760 B2 * 3/2008 Gong ..... B01L 3/5027 435/6.11
7,579,172 B2 * 8/2009 Cho ..... B01L 3/5027 435/6.12
8,122,909 B2 * 2/2012 Tonkovich ..... B01F 5/0611 137/833
8,202,492 B2 * 6/2012 Linder ..... B01L 3/5027 422/503
8,215,338 B2 * 7/2012 Delattre ..... B01J 19/0093 137/599.06
8,313,906 B2 * 11/2012 Cao ..... C12N 15/1017 435/283.1
8,534,909 B2 * 9/2013 Guidat ..... B01F 5/0603 366/336
8,567,425 B2 * 10/2013 Tan ..... B01L 3/50273 137/3
8,591,829 B2 * 11/2013 Taylor ..... B01L 3/5027 422/502
9,174,211 B2 * 11/2015 Jones ..... B01L 3/50273
9,255,866 B2 * 2/2016 Dirckx ..... G01N 1/38
9,328,849 B2 * 5/2016 Peng ..... B01L 3/50273
9,771,553 B2 * 9/2017 Vulto ..... B01F 13/0083
2002/0036018 A1 3/2002 McNeely et al.
2002/0064483 A1 * 5/2002 Sando ..... B01F 5/0256 422/505
2004/0184964 A1 * 9/2004 Watanabe ..... B01F 5/0646 422/502
2005/0106066 A1 * 5/2005 Saltsman ..... B01F 5/0473 422/504
2005/0133101 A1 6/2005 Chung et al.
2005/0272144 A1 * 12/2005 Sando ..... B01F 5/0475 435/287.2
2007/0113908 A1 * 5/2007 Lee ..... B01L 3/502738 137/833
2008/0112850 A1 * 5/2008 Higashino ..... B01F 5/0646 422/68.1
2008/0190773 A1 * 8/2008 Johnson ..... G05D 7/0694 204/601
2008/0295909 A1 * 12/2008 Locascio ..... B01F 5/0646 137/833
2009/0087925 A1 * 4/2009 Wagner ..... B01F 5/061 436/518
2011/0220498 A1 * 9/2011 Ko ..... B01L 3/502753 204/451
2012/0180894 A1 * 7/2012 Sugahara ..... B41J 2/16505 137/827
2014/0182726 A1 * 7/2014 Yasuda ..... B01F 5/0082 137/833
2016/0214108 A1 * 7/2016 Solomon ..... B01L 3/502715
2017/0074870 A1 * 3/2017 Konry ..... B01F 5/0647
2017/0165663 A1 * 6/2017 Hong ..... B01J 13/00

* cited by examiner

VALVE-LESS MIXING METHOD AND MIXING DEVICE

CROSS-REFERENCE TO RELATED APPLICATION

The present application is a national stage entry of PCT/EP2016/065065 filed Jun. 28, 2016, which claims priority to European Patent Application No. 15174301.0 filed Jun. 29, 2015, the contents of which are hereby incorporated by reference.

FIELD OF THE DISCLOSURE

The present disclosure to fluidic devices for mixing fluids. In particular, the disclosure relates to fluidic device for mixing fluids without the use of valves.

BACKGROUND

In recent years, portable point of care devices have received increasing interest. Such devices often use capillary forces to propagate fluids in the devices.

These passive microfluidics require a means for controlling the fluid flow. Typically valves, such as capillary trigger valves are used. However, a problem related to such devices is that planar micro-machined capillary trigger valves are unreliable. Increasing the reliability of such valves requires also increasing the complexity of the manufacturing process. To keep the total cost of passive flow devices low, the complexity of the manufacturing process should be minimal.

There is a need for passive flow devices which are able to control the liquid flow without using valves, which are easy to fabricate and which are highly reliable.

SUMMARY

It is an object of the present disclosure to provide fluidic devices and corresponding methods for mixing fluids whereby the fluidic devices can be operated without using valves.

Example embodiments of the present disclosure provide fluidic devices for mixing fluids that can be fabricated quite easily because they do not require reliable valves.

In example embodiments of the present disclosure, fluidic devices for mixing fluids are provided and corresponding methods for mixing are provided that are highly reliable in operation, because they are not making use of valves.

In a first aspect of the disclosure, a fluidic device for mixing a reagent fluid with a fluid sample is presented, comprising: a supply channel having a reagent inlet for providing the reagent fluid in the supply channel and a sample inlet for providing the fluid sample in the supply channel; a first reagent storage for storing the reagent fluid, coupled to the supply channel; a mixer for mixing the reagent with the fluid sample, having a mixer inlet and a mixer outlet, the mixer inlet coupled to the supply channel at a position in between the sample inlet and the first reagent storage; and wherein the fluidic device is configured such that in a first stage, when the reagent fluid is supplied in the reagent inlet, the reagent is provided in the supply channel and the first reagent storage, and such that the reagent is thereafter stationed in the supply channel and the first reagent storage until a fluid sample is provided in the sample inlet; and wherein the fluidic device is further configured such that in a second stage, when the fluid sample is supplied in the sample inlet, the supplied fluid sample and the stationed reagent flows into the mixer thereby mixing both fluids.

According to an example embodiment of the disclosure, the first reagent storage is coupled to the supply channel via a first fluidic structure, the mixer is coupled to the supply channel via a second fluidic structure, the first and the second fluidic structures are adapted such that a capillary pressure in the first fluidic structure is higher than a capillary pressure in the second fluidic structure such that, during the first stage, the reagent fluid flows into the first reagent storage and not into the mixer, and a capillary pressure in the first reagent storage is higher than a capillary pressure in the second fluidic structure such that the reagent fluid is stationed in the supply channel and the first reagent storage, after supplying the reagent and before providing the fluid sample in the sample inlet; and the mixer and the first reagent storage are adapted such that a capillary pressure in the mixer is higher than a capillary pressure in the first reagent storage such that the supplied fluid sample and the stationed reagent flow into the mixer.

According to an example embodiment of the disclosure, the reagent inlet is adapted to accommodate a volume that is smaller than a volume of the first reagent storage and the supply channel combined.

According to an example embodiment of the disclosure, the first fluidic structure is a first fluidic channel forming the coupling between the first reagent storage and the supply channel, the second fluidic structure is a second fluidic channel forming the coupling between the mixer and the supply channel, and the width of the first and the second fluidic channels are adapted such that a capillary pressure in the first fluidic channel is higher than a capillary pressure in the second fluidic channel.

According to an example embodiment of the disclosure, the first and/or the second fluidic structure comprise pillars which are in direct contact with a fluid sample, when present in the first and/or the second fluidic structure, and which are arranged such that a capillary pressure in the first fluidic structure is higher than a capillary pressure in the second fluidic structure.

According to an example embodiment of the disclosure, the first reagent storage and the mixer each comprise fluidic channels of which the widths are adapted such that a capillary pressure in the mixer is higher than a capillary pressure in the first reagent storage.

According to an example embodiment of the disclosure, the first reagent storage and/or the mixer comprise pillars arranged such that a capillary pressure in the mixer is higher than a capillary pressure in the first reagent storage.

According to an example embodiment of the disclosure, all fluidic components are closed.

According to an example embodiment of the disclosure, the fluidic device further comprises a glass cover positioned such that at least the supply channel, the first reagent storage and the mixer are closed.

According to an example embodiment of the disclosure, all components of the fluidic device are fabricated in a silicon wafer.

According to an example embodiment of the disclosure, the fluidic device is valve-less.

Further, a multi-step assay device is presented, comprising: a fluidic device as described above; a fluidic channel coupled to the mixer outlet; a second reagent storage coupled to the fluidic channel via a third fluidic structure; a third reagent storage coupled to the fluidic channel via a fourth fluidic structure; a first fluidic component coupled to the fluidic channel in between the third and the fourth fluidic structure; a second fluidic component coupled to the first fluidic component via a fifth fluidic structure; a third fluidic component coupled to the second fluidic component via a sixth fluidic structure; and wherein the multi-step assay device is adapted such that: a capillary pressure in the third fluidic structure is higher than a capillary pressure in the fifth fluidic structure; a capillary pressure in the fifth fluidic structure is higher than a capillary pressure in the fourth fluidic structure; a capillary pressure in the fourth fluidic structure is higher than the capillary pressure in the sixth fluidic structure; a capillary pressure in the second fluidic component is higher than the capillary pressure of the second reagent storage; a capillary pressure of third fluidic component is higher than a capillary pressure in the third reagent storage.

Further, a multi-step assay device for DNA analysis is presented, comprising a multi-step assay device as described above and wherein the first fluidic component is a PCR chamber.

Further, a sensing system is presented, comprising: a fluidic device as described above; a sensor coupled to mixer outlet and arranged for sensing an analyte in a mixed fluid sample exiting the mixer.

In a second aspect of the disclosure, a method for mixing a reagent fluid with a fluid sample using a fluidic device as described above is presented, comprising: in a first stage: providing the reagent fluid in the reagent inlet, wherein the provided reagent fluid is lower than a volume of the first reagent storage and the supply channel combined; thereafter allowing the reagent fluid to flow into the supply channel and the first reagent storage; thereafter in a second stage: providing the fluid sample in the sample inlet.

In one aspect, the present disclosure also relates to a diagnostic device for diagnosing a status of an object or a patient, the diagnostic device comprising a fluidic device as described above and a sensor coupled to a mixer outlet and arranged for sensing an analyte in a mixed fluid sample exiting the mixer, the sensor providing an output on which the diagnosing can be based.

Particular aspects of the disclosure are set out in the accompanying independent and dependent claims. Features from the dependent claims may be combined with features of the independent claims and with features of other dependent claims as appropriate and not merely as explicitly set out in the claims.

These and other aspects of the disclosure will be apparent from and elucidated with reference to the embodiment(s) described hereinafter.

Figure 1:
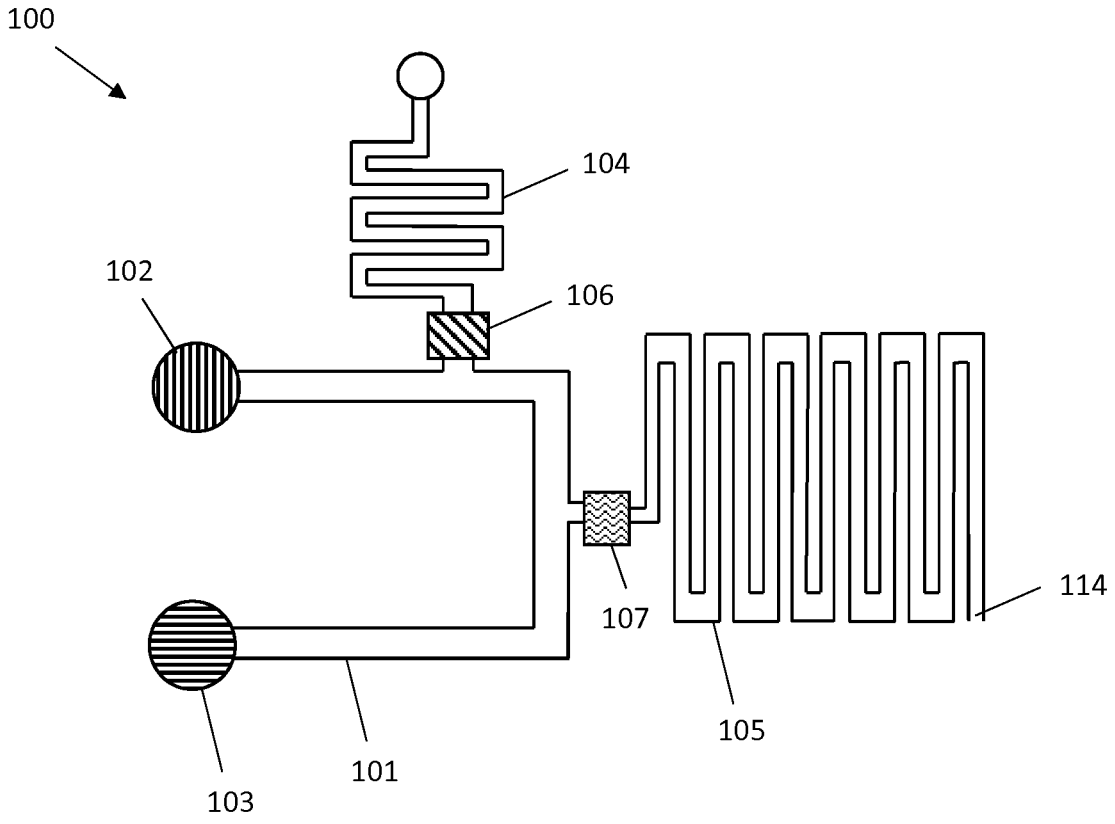
FIG. 1 illustrates a valve-less fluidic device for mixing two fluids according to an example embodiment.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION

The present disclosure will be described with respect to particular embodiments and with reference to certain drawings but the disclosure is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the disclosure.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the disclosure described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present disclosure, the only relevant components of the device are A and B.

Reference throughout this specification to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Throughout the description reference is made to "fluid sample". "Fluid sample" may refer to a body fluid that can be isolated from the body of an individual. Such a body fluid may refer to, but not limited to, blood, plasma, serum, bile, saliva, urine, tears, and perspiration. Fluid sample may also refer to any fluid suitable for transporting objects or components in a fluidic or micro-fluidic system.

Throughout the description reference is made to "reagent fluid". "Reagent fluid" may refer to a substance or compound which may be added to a fluid sample in order to bring about a chemical reaction, e.g. a detectable chemical reaction.

Throughout the description reference is made to "capillary pressure". "Capillary pressure" may refer to the negative pressure created by the liquid-vapour interface which balance the surface tension forces between the liquid, vapour and solid phases. The "capillary pressure" is the driving force in capillary microfluidic systems. It is a function of the contact angle where the liquid-vapour interface meets the solid surfaces of the fluidic structure, the liquid-vapour surface tension coefficient and the geometry of the fluidic structure (e.g., height and width of a rectangular cross-section channel or diameter of a circular cross-section channel).

Throughout the description reference is made to the term "stationed". This term may refer to a fluid that is maintained in certain fluidic components of the device without propagating or leaking into other fluidic components.

The problem related to the unreliability and high manufacturing cost is solved by designing a system that relies on capillary pressure differences in the fluidic device. By correctly dimensioning these capillary pressure differences, in a first stage a first fluid can be supplied to the device which is stored in the device until a second fluid is introduced. Only after the introduction of the second fluid, the stored first fluid is mixed with the second fluid. By correctly dimensioning all fluidic components, the use of valves can be eliminated. This removes the problem of high cost and unreliability.

Example embodiments are detailed below.

In a first aspect of the disclosure, a fluidic device for mixing two fluids or more is presented. The two fluids can be a reagent fluid and a fluid sample. The fluidic device solely relies on capillary pressure differences present in the device to mix the fluids. Hence, the fluidic device is valveless and can be considered as a passive mixing device. The fluidic device may for example be a microfluidic device, meaning that it deals with the behaviour, precise control and/or manipulation of fluids that are geometrically constrained to a small, typically sub-millimeter, scale. In such devices, typically small volumes of fluid are dealt with such as for example microliters, nanoliters, picoliters or even femtoliters. One or more dimensions of one or more of the fluidic channels may be smaller than 1000 μm, e.g. smaller than 500 μm, e.g. smaller than 100 μm. Effects of the micro-domain may play a role in such devices.

An example embodiment is illustrated in FIG. 1.

The fluidic device 100 comprises a supply channel 101 fluidically connected on one end with a reagent inlet 102. The other end of the supply channel 101 is fluidically connected to sample inlet 103. Thus, both ends of the supply channel are connected to an inlet. The supply channel 101 is a fluidic channel, e.g. a channel having micro-fluidic dimensions.

The fluidic device 100 further comprises a first reagent storage 104. The first reagent storage 104 is fluidically connected to the supply channel 101. The first reagent storage 104 functions as a fluidic storage component for a fluid supplied to it via the supply channel 101. The first reagent storage 104 may be a fluidic compartment or a fluidic channel, e.g. a micro-fluidic channel. The first reagent storage 104 may have micro-fluidic dimensions. The first reagent storage 104 may feature an air vent for allowing the first reagent storage 104 to be filled with a fluid via the supply channel 101.

The fluidic device 100 further comprises a mixer 105 having an inlet and an outlet 114. The inlet of the mixer 105 is fluidically connected to the supply channel 101. The connection of the mixer 105 to the supply channel 101 is located in between the location of the connection of the first reagent storage 104 to the supply channel 101 and the location of the sample inlet 103. The mixer 105 mixes fluids supplied to the fluidic device 100 via the reagent inlet 102 and sample inlet 103. A mixed fluid exits the mixer 105 via the mixer outlet 114. The mixer 105 may be a fluidic channel or a fluidic compartment, e.g. having micro-fluidic dimensions.

In a first stage, a reagent fluid is supplied in the reagent inlet 102. By capillary force the reagent fluid enters the supply channel 101 and flows in the supply channel 101. The fluidic device 100 is configured such that the reagent fluid flows into the first reagent storage 104 instead of in the mixer 105. Thus, during the first stage, the supplied reagent fluid flows in the supply channel 101 and in the first reagent storage 104. The fluidic device 100 is further configured such that when the reagent fluid is completely contained in the supply channel 101 and in the reagent storage 104, the reagent fluid is stationed or maintained in the supply channel 101 and in the first reagent storage 104. Thus, as long as no other fluids are supplied to the supply channel 101, the reagent fluid is kept or maintained in the supply channel 101 and the first reagent storage 104. Also, the reagent fluid does not flow into the mixer 105.

In a second stage, a fluid sample is supplied in the sample inlet 103. Upon supplying the fluid sample to the sample inlet 103, the fluid sample meets the reagent fluid already in the supply channel 101. The fluidic device 100 is configured such that by supplying this fluid sample via the sample inlet 103, the fluid sample and the stored reagent in the reagent storage 104 are sucked by capillary forces into the mixer 105 thereby mixing both fluids.

According to an example embodiment, the first reagent storage 104 is fluidically connected to the supply channel 101 via a first fluidic structure 106. Thus, a fluid supplied in the supply channel 101 flowing into the first reagent storage 104 flows through the first fluidic structure 106 first before entering the first reagent storage 104. In other words, the first fluidic structure 106 forms the coupling between the first reagent storage 104 and the supply channel 101.

According to an embodiment, the inlet of the mixer 105 is fluidically connected to the supply channel 101 via a second fluidic structure 107. Thus, a fluid supplied in the supply channel 101 and flowing into the mixer 105 flows through the second fluidic structure 107 first before entering the mixer 105. In other words, the second fluidic structure 107 forms the coupling between the mixer 105 and the supply channel 101.

According to an example embodiment, the first 106 and the second 107 fluidic structures are adapted such that the capillary pressure present in the first fluidic structure 106 is higher than the capillary pressure present in the second fluidic structure 107. Due to this difference in capillary pressure, the reagent fluid supplied in the reagent inlet 102 flows into the first reagent storage 104 and not into the mixer 105.

According to an example embodiment, to realize this pressure difference between the first 106 and the second 107 fluidic structure, the first 106 and the second 107 fluidic structure are each fluidic channels which respectively form the coupling between the first reagent storage 104 and the supply channel 101 and the coupling between the mixer 105 and the supply channel 101. The inner dimensions, e.g. width or the diameter, of these fluidic channels are adapted such that a capillary pressure difference is created between the fluidic channels. For example, the inner dimensions (e.g. the width or the diameter) of the first fluidic structure 106 are smaller than the inner dimensions (e.g. the width or the diameter) of the second fluidic structure 107.

According to another example embodiment, the first 106 and/or the second 107 fluidic structure comprises pillars which are arranged such that a capillary pressure in the first fluidic structure 106 is higher than a capillary pressure in the second fluidic structure 107. For a fixed contact angle and surface tension coefficient, the capillary pressure is a function of the surface area to volume ratio of the fluidic structure. A greater surface area to volume ratio yields a higher capillary pressure. The contact angle relates to the hydrophilicity or hydrophobicity of the surface. A lower contact angle yields a higher capillary pressure. The pillars may be micro-pillars which are positioned on one or more inner surfaces of the first 106 and/or the second 107 fluidic structures. The position, the size and the pitch between the pillars are selected such that the capillary pressure difference between the first 106 and/or the second 107 fluidic structure is realized. Decreasing the pitch and increasing the size (diameter) of the pillars increase the surface to volume ratio, hence increase the capillary pressure. Thus, the first 106 and/or the second 107 fluidic structures may be fluidic channels featuring pillars located on their inner surfaces.

According to an embodiment of the invention, the first reagent storage 104 is adapted such that the capillary pressure present in the first reagent storage 104 is higher than the capillary pressure present in the second fluidic structure 107. Due to this difference in capillary pressure, as long as no other fluids are provided to the fluidic device 100, the reagent fluid is stationed in the supply channel 101 and the first reagent storage 104. In other words, the reagent fluid does not flow into the mixer 105 until a sample fluid is provided to the fluidic device 100 via the sample inlet 103.

According to an example embodiment, the first reagent storage 104 is a fluidic channel of which the inner dimensions are adapted such that the capillary pressure present in the first reagent storage 104 is higher than the capillary pressure in the second fluidic structure 107. For example, the width or the diameter inside the first reagent storage 104 are adapted. Alternatively, the first reagent storage 104 may feature micro-pillars present on one or more inner surface of the first reagent storage 104. The position, the size and the pitch between the pillars are selected such that the required capillary pressure in the first reagent storage 104 is realized. According to a particular embodiment, the first reagent storage 104 is a fluidic compartment.

According to an example embodiment, the mixer 105 and the first reagent storage 104 are adapted such that a capillary pressure in the mixer 105 is higher than a capillary pressure in the first reagent storage 104. As described earlier, this is realized, for example, by changing the inner dimensions of each component or by placing pillars in each component.

When a sample fluid is provided in the sample inlet 103, the previously stationary reagent fluid and the supplied sample fluid flow into the mixer 105. Because the capillary pressure in the second 107 fluidic structure is higher than the capillary pressure in the sample inlet 103 and because the capillary pressure present in the mixer 105 is higher than the capillary pressure in the first reagent storage 104, any fluid present in the supply channel 101 and the first reagent storage 104 is sucked into the mixer 105. Hence, the reagent fluid and the sample fluid are mixed.

According to an example embodiment, the mixer 105 is a fluidic channel of which the inner dimensions are adapted such that the capillary pressure present in the mixer 105 is higher than the capillary pressure present in the first reagent storage 104. For example, the width or the diameter inside the mixer 105 are adapted. Alternatively, the mixer 105 may feature micro-pillars present on one or more inner surface of the mixer 105. The position, the size and the pitch between the pillars are selected such that the required capillary pressure in the mixer 105 is realized. According to a particular embodiment, the mixer 105 is a fluidic compartment.

According to an example embodiment, the supply channel 101, the mixer 105 and the first reagent storage 104 are closed fluidic components. The reagent inlet 102 and the sample inlet 103 may be open inlets which allow the provision of fluids into the fluidic device 100. The reagent inlet 102 and/or the sample inlet 103 may also be closed fluidic components, for example closed reservoirs which can release their content into the supply channel 101, for example, when triggered electrically or mechanically. Thus, the fluidic device 100 may be completely or partially closed. For closing the fluidic device 100, a cover, e.g. glass or polymer, may be bonded to the substrate thereby closing open fluidic components of the fluidic device 100.

According to an example embodiment, the volume of the reagent inlet 102 is smaller than a volume of the first reagent storage 104 and the supply channel 101 combined.

When the reagent inlet 102 is an open inlet used to provide a reagent fluid from the outside world into the fluidic device 100, the volume of the reagent inlet 102 should not be restricted. However, in such a situation, care should be taken to not provide more volume of the reagent fluid into the reagent inlet 102 than the volume of the supply channel 101 and the first reagent storage 104 combined. If more volume is provided, the capillary pressure difference between the reagent inlet 102 and the second 107 fluidic structure will be sufficient to cause the reagent fluid to flow past the second fluidic structure 107 into the mixer 105 before the sample fluid is provided. This situation should be avoided.

When the reagent inlet 102 is a reservoir (e.g. a fluidic compartment) which already contains the reagent fluid, the volume of this reservoir should be less than the volume of the supply channel 101 and the first reagent storage 104 combined. When the reagent fluid is released from the reservoir into the supply channel 101, all the reagent fluid can flow into the supply channel 101 and the first reagent storage 104 without overcoming the capillary pressure generated within the second 107 fluidic structure. Hence, the reagent fluid can be stationed in the supply channel 101 and the first reagent storage 104 until the sample fluid is provided.

According to an example embodiment, the fluidic device 100 comprises at least one detector which detects whether a reagent fluid is sufficiently supplied in the reagent storage 104 and supply channel 101. The detector may be connected to a controller which activates the release of a fluid sample present in the sample inlet 103 in the supply channel 101, upon detection. The reagent fluid and the fluid sample may be provided to the fluidic device 100 at the same time without jeopardizing the functioning of the fluidic device 100. In other words, the sample fluid provided in the sample inlet 103 will only be released to the supply channel 101 when the reagent fluid is sufficiently present in the reagent storage 104 and, optionally, in the supply channel 101.

Because a fluid sample is introduced into the supply channel 101 only when that supply channel 101 is already filled with the reagent, the fluid sample and the reagent can be mixed without generating air bubbles. Hence, it is an object of the disclosure to provide a mixing device which can mix at least two fluids without generating air bubbles in the mixed fluid.

According to an example embodiment, the detector is configured to measure the volume of the reagent fluid supplied in the reagent inlet 102. The controller connected to the detector may be configured to stop the release of the reagent fluid into the supply channel 101 when a maximum is reached. For example, this maximum can be set to be equal to the volume of the supply channel 101 and the reagent storage 104 combined. Thus, no leaking of the reagent fluid into the mixer occurs before a sample fluid is supplied.

For stopping the release of a reagent fluid or sample fluid in the supply channel 101, the fluidic device 100 may comprise valves which are connected to and operable via the controller.

It is to be noticed that some embodiments of the present disclosure are real valve-less microfluidic devices. In some other embodiments, e.g. at least the valve for allowing transfer from a supply channel to the mixer can be avoided.

According to an example embodiment, the fluidic device 100 comprises: a silicon substrate which features the fluidic components, and optionally a cover for closing the fluidic components. The fluidic device may be fabricated in a single piece of silicon, in which all fluidic components are patterned, e.g. etched, using semiconductor processing steps, e.g. CMOS compatible processing steps.

According to an example embodiment, a valve-less multi-step assay device is presented. This assay device comprises a fluidic device 100 according to the first aspect of the disclosure. The fluidic device 100 further comprises one or more further reagent storages which each are individually coupled to the mixer outlet 114 using a fluidic structure similar to the first 106 or second 107 fluidic structure. Each of these further reagent storages have an inlet allowing a fluid to be provided into each reagent outlet and be stationed there. The careful adaptation of the different fluidic structures allow a plurality of fluids to be mixed in a valve-less manner.

Figure 2:
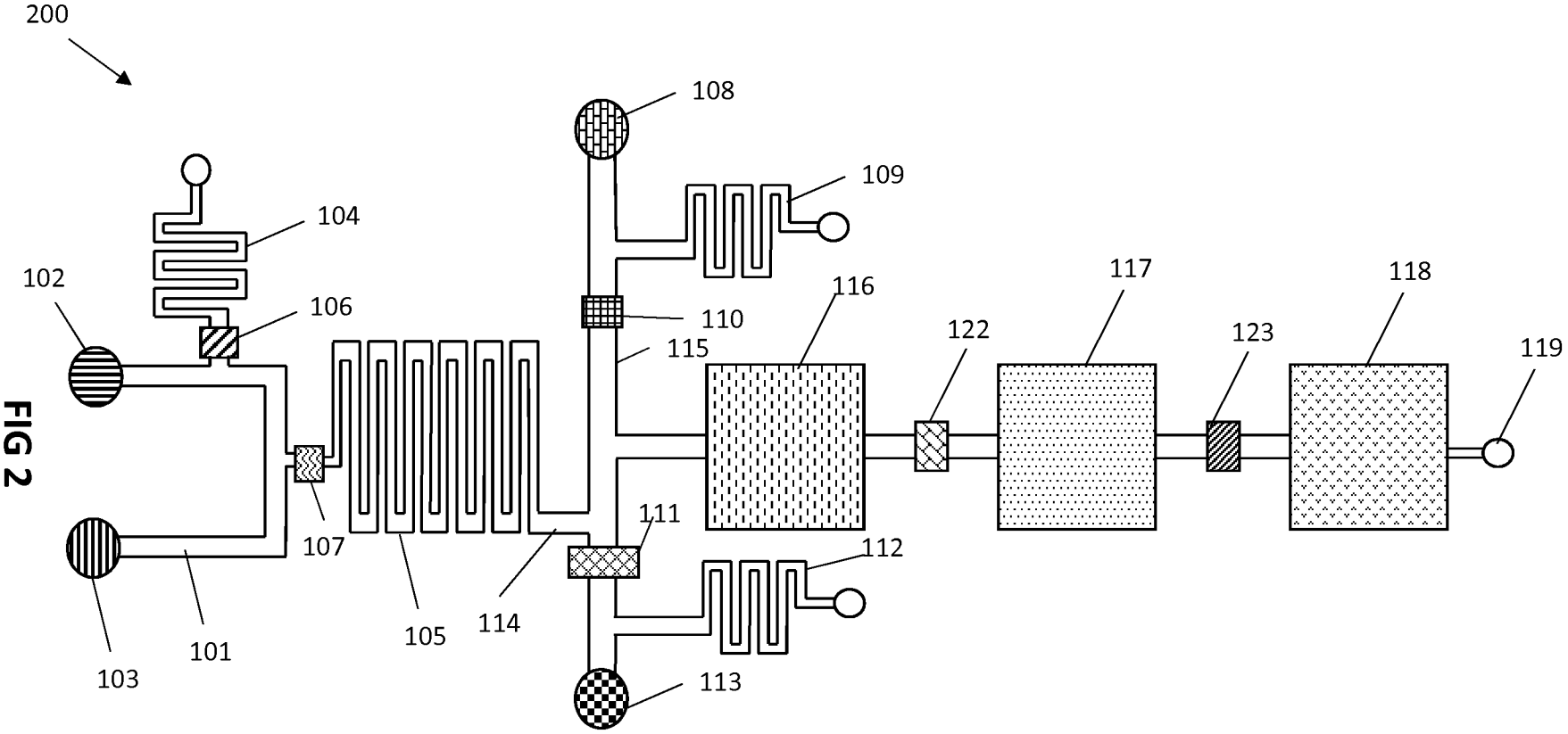
FIG. 2 illustrates a valve-less multi-step assay system according to an example embodiment.

An embodiment of a valve-less multi-step assay device 200 is illustrated in FIG. 2. FIG. 2 comprises a fluidic device 100 as illustrated in FIG. 1. Further, the mixer outlet 114 is coupled to a fluidic channel 115. A second 109 and a third 112 reagent storage are coupled to the fluidic channel 115, respectively via a third 110 and a fourth 111 fluidic structure. The second 109 and the third 112 reagent storage each has an inlet 108, 113 for providing a fluid in them.

A first fluidic component (such as capillary pump, reaction chamber, detection chamber, etc.) 116 is coupled to the fluidic channel 115. A second fluidic component 117 is coupled to the first fluidic component 116 via a fifth fluidic structure 122. A third fluidic component 118 is coupled to the second fluidic component 117 via a sixth fluidic structure 123. The fluidic components 116, 117, 118 are fluidically connected such that a fluid arriving in the first component 116 via the fluidic channel 115 can flow through the first component 116 and into the second component 117. A fluid arriving in the second component 117 can flow through the second component 117 and into the third component 118. A fluid exits the third component via outlet 119.

The third fluidic structure 110 is adapted such that the fluid stored in the second reagent storage 109 is released to the fluidic channel 115, only when the mixed fluid from first reagent fluid and fluid sample completely fills fluidic component 116 and reaches the fifth fluidic structure 122, because the capillary pressure in the third fluidic structure 110 is higher than the capillary pressure at the fifth fluidic structure 122. Once the fluids in channel 115 and the second reagent storage 109 are fluidically connected, the fluid in the fluidic component 116 is sucked into the fifth fluidic structure 122 as the capillary pressure in the fifth fluidic structure 122 is higher than the capillary pressure in the inlet 108. After that, the fluid in the second reagent storage 109 is sucked by the fluidic component 117 as the capillary pressure at the fluidic component 117 is higher than the capillary pressure in the second reagent storage 109. The capillary pressure in the sixth fluidic structure 123 is less than the capillary pressure at a fourth fluidic structure 111. Hence, the liquid in the third reagent storage 112 is released to the fluidic channel 115 when the fluidic component 117 is filled. When the fluids in channel 115 and the second reagent storage 109 are connected, the liquid at fluidic component 117 is sucked into sixth fluidic structure 123 as the capillary pressure at sixth fluidic structure 123 is higher than the capillary pressure at inlet 113. The fluid in the third reagent storage 112 is sucked by the fluidic component 118 as the capillary pressure at fluidic component 118 is higher than the capillary pressure in third reagent storage 112. Vents (not shown in FIG. 2) are added to the third 110 and fourth 111 fluidic structures and to release the confined air when the fluid in the fluidic channel 115 is connected to the fluids in the second 109 and third 112 reagent storages, respectively. The device is designed such that the flow resistance between the fluidic component 117 and second reagent storage 109 is much less than the flow resistance between the fluidic component 117 and the inlet port 103 to assure that the liquid stored in the second reagent storage 109 is sucked to the fluidic component 117 and not the rest of the sample. The device is designed such that the flow resistance between the fluidic component 118 and the third reagent storage 112 is much less than the flow resistance between the fluidic component 118 and the inlet port 103 to assure that the liquid stored in the third reagent storage 112 is sucked to the fluidic component 118 and not the rest of the sample. The design is adapted such that the volume of the fluidic component 116 plus the volume of the mixer 105 combined is less than the volume of the storage element 104 to avoid sucking sample without mixing with the reagents. The design is also adapted such that the volume of the fluidic component 117 is less than the volume of the second reagent storage 109 and equal to the volume of the fluidic component 116 to fill it completely with the second reagent fluid (wash buffer). The design is also adapted such that the volume of the fluidic component 118 is less than the volume of the second reagent storage 112 and equal to the volume of the fluidic component 116 to fill it completely with the third reagent fluid (PCR reagents).

According to an example embodiment, the fluidic device as illustrated in FIG. 1 or FIG. 2 may further be coupled to components for further processing on the mixed fluids. Such components may for example be fluidic components such as a PCR chamber, a fluidic mixer. Such components may also comprise one or more sensors for sensing the mixed fluid, e.g. a biosensor or an image sensor.

Figure 3:
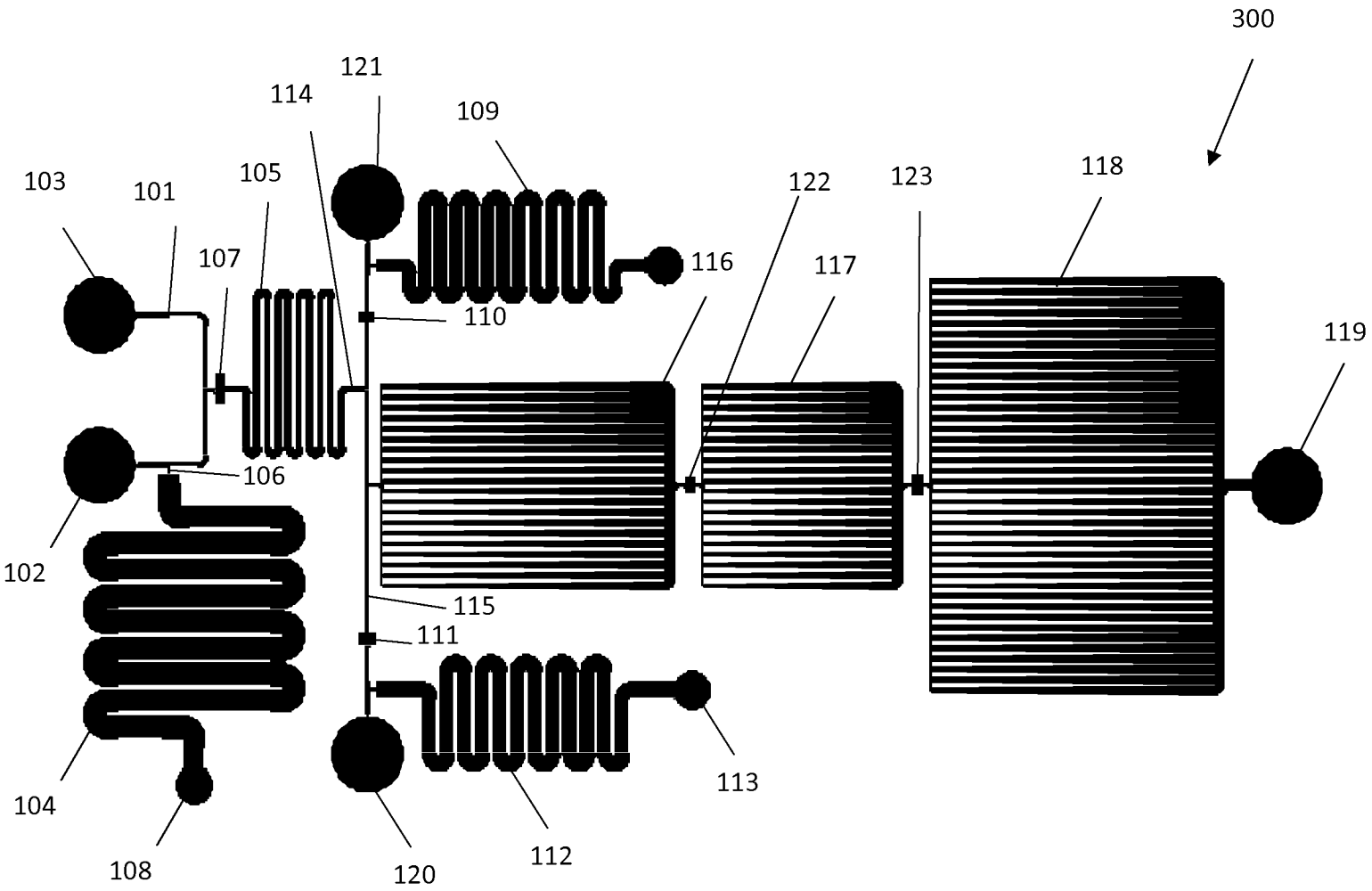
FIG. 3 illustrates a valve-less multi-step assay for DNA analysis according to an example embodiment.

FIG. 3 illustrates a valve-less multi-step assay device 300 for DNA analysis. This device 300 comprises a fluidic device 200 as illustrated in FIG. 2. The first fluidic component 116 is a PCR chamber. The first component 116 is configured to perform, DNA extraction, DNA amplification and DNA detection. The sample inlet port 103 functions as a plasma inlet port. The reagent inlet 102 is used to supply a binding buffer to the fluidic device 100. The first reagent storage 104 is used to store the binding buffer. The second reagent storage 109 is used to store a wash buffer. The inlet 121 associated to the second reagents storage 109 is used to provide the wash buffer in the second reagent storage 109. The third reagent storage 112 is used to store PCR reagents. The inlet 120 associated to the third reagents storage 112 is used to provide the PCR reagents in the third reagent storage 112. The second 117 and third 118 components are supplied to store the excess binding buffer and wash buffer. So, the second 117 and third 118 components are optional.

In a first stage, the plasma and the binding buffer are mixed in the mixer 105 and transferred to the first component 116 where the DNA binds to the surfaces of the component, in this case a PCR chamber. In a second stage, the binding buffer is displaced from the first component 116 into the second component 117 by the wash buffer. In a third stage, the PCR reagents displace the wash buffer from the first component 116 to the second component 117, whereby the binding buffer is displaced into the third component 118. The PCR reagents also serves as an elution buffer to elute the bound DNA from the surfaces of component 116 into the PCR reagents fluid. After processing, the fluid flows into the outlet 119.

DNA analysis may be performed without the use of active valves. Furthermore, the full system may be implemented in silicon and may be fabricated using cheap semiconductor processing techniques. In addition, DNA analysis may be performed in a very compact device without the need of additional devices, e.g. on a single substrate.

Figure 4:
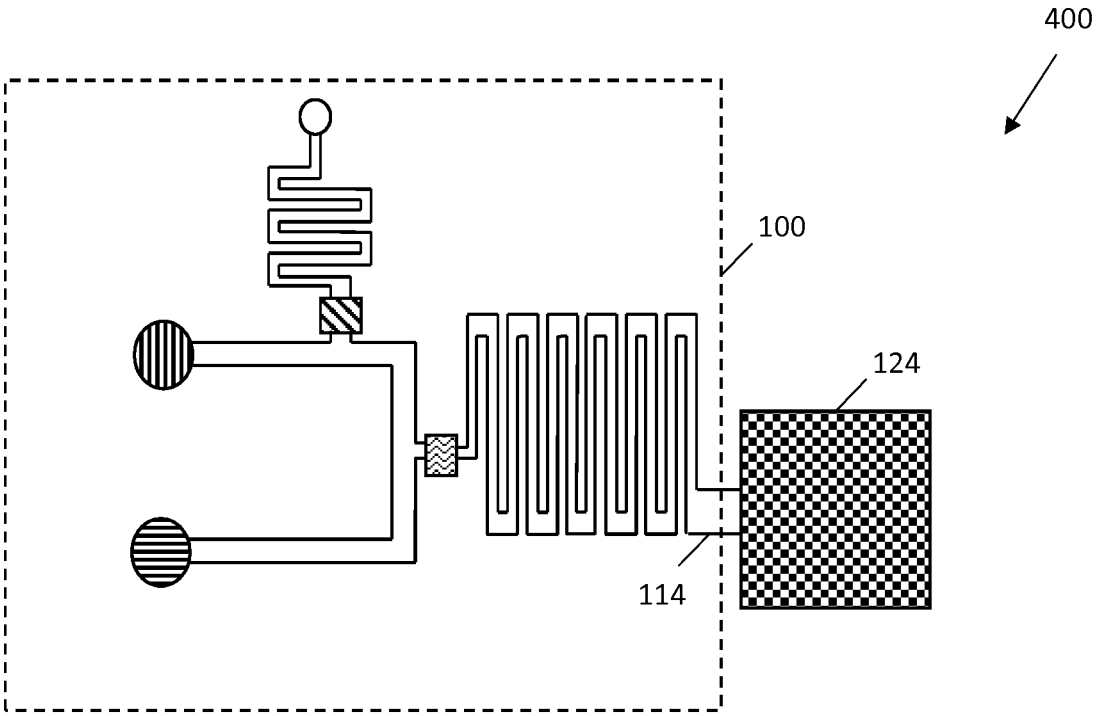
FIG. 4 illustrates a valve-less device for sensing an analyte in a fluid sample according to an example embodiment.

According to another aspect of the disclosure, a sensing system 400 is presented. An embodiment of the sensing system 400 is illustrated in FIG. 4. The sensing system 400 comprises: a fluidic device 100 according to the first aspect of the disclosure, and a sensor 124. The sensor 124 may be a sensor capable of sensing an analyte. The sensor 124 may be a biosensor. The sensor 124 may also be an image sensor, e.g. for detecting fluorescence. The sensor may be positioned downstream of the mixer 105. Thus, the sensor 124 is positioned such that after the mixing of the fluids, sensing on the mixed fluids can be performed. For example, the sensor 124 is coupled to the mixer outlet 114.

According to an example embodiment, all fluidic components of the fluidic device are passive fluidic components. In other words, the fluidic components do not contain any moving parts. In other words, any device presented in this disclosure can be defined as a "valve-less" device.

Figure 5A:
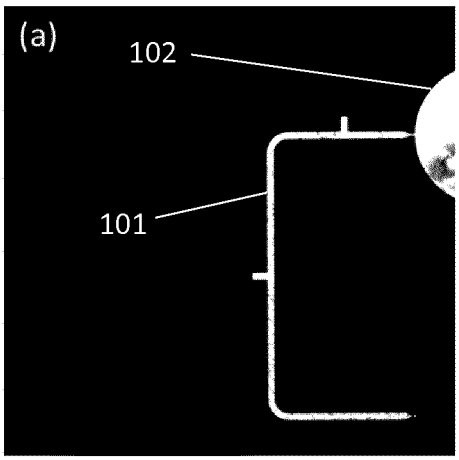
FIG. 5*a*-5*d* illustrate image sequences of fluorescently dyed water propagating in the fluidic device according to an example embodiment.
Figure 5B:
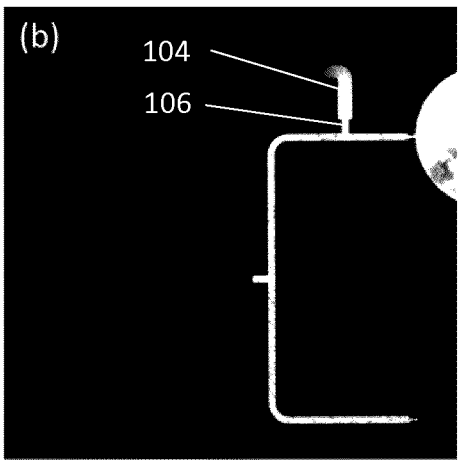
Figure 5C:
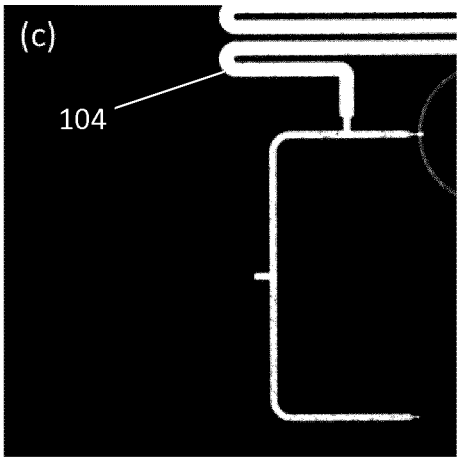
Figure 5D:
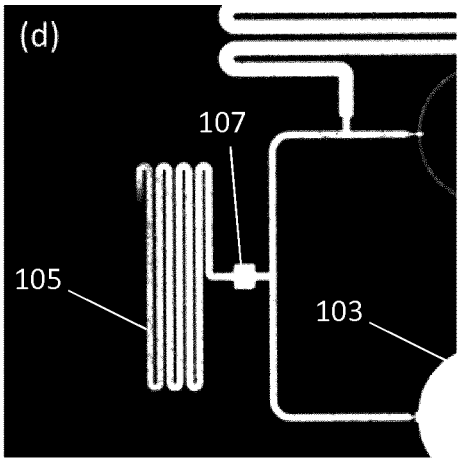

FIG. 5*a*-5*d* illustrate image sequences of an experiment where fluorescently dyed water is supplied to the fluidic device 100 and propagates through the capillary system. In FIG. 5*a* a reagent fluid is provided in the reagent inlet 102. In FIG. 5*b* the reagent fluid fills the supply channel 101 and starts to fill the first reagent storage 104 via the first fluidic structure 106. In FIG. 5*c* the supply channel 101 and the first reagent storage 104 is filled and the reagent fluid is stationed there. The reagent inlet 102 is now completely empty and the provided volume of reagent fluid is completely contained within the supply channel 101 and the first reagent storage 104. In FIG. 5*d* the fluid sample is added to the sample inlet 103. The stationed reagent fluid and the fluid sample are both sucked into the mixer 105 via the second fluidic structure 107 where mixing of both reagent and sample fluids occurs.

According to a second aspect of the disclosure, a method for mixing a reagent fluid with a fluid sample is presented. The method comprises the use of a fluidic device 100 according to the first aspect of the disclosure. In a first stage, the reagent fluid is provided in the reagent inlet 102. The volume of the provided reagent fluid is lower than the volume of the first reagent storage 104 and the supply channel 101 combined. Thus, the reagent fluid can be completely contained and stored in the first reagent storage 104 and the supply channel 101, and does not leak into the mixer 105. In a second stage, the reagent fluid is allowed to flow into the supply channel 101 and the first reagent storage 104. When the reagent fluid is completely contained in the supply channel, in a third step, the fluid sample is provided in the sample inlet 103.

According to an example embodiment, a method for sensing an analyte in a fluid is presented. The method comprises the steps as described in the second aspect of the disclosure and furthermore comprising a fourth step of performing sensing on the mixed fluid exiting the mixer 105.

The invention claimed is:

1. A fluidic device for mixing a reagent fluid with a fluid sample, comprising:

a supply channel having a reagent inlet for providing the reagent fluid in the supply channel and a sample inlet for providing the fluid sample in the supply channel;

a first reagent storage for storing the reagent fluid, coupled to the supply channel;

a mixer for mixing the reagent fluid with the fluid sample, having a mixer inlet and a mixer outlet, the mixer inlet coupled to the supply channel at a position in between the sample inlet and the first reagent storage; and wherein the fluidic device is configured such that in a first stage, when the reagent fluid is supplied in the reagent inlet, the reagent fluid is provided in the supply channel and the first reagent storage, and such that the reagent fluid is thereafter stationed in the supply channel and the first reagent storage until the fluid sample is provided in the sample inlet; and wherein the fluidic device is further configured such that in a second stage, when the fluid sample is supplied in the sample inlet, the supplied fluid sample and the stationed reagent fluid flows into the mixer thereby mixing both fluids.

2. The fluidic device according to claim 1, wherein the first reagent storage is coupled to the supply channel via a first fluidic structure, wherein the mixer is coupled to the supply channel via a second fluidic structure, wherein, the first fluidic structure and the second fluidic structure are adapted such that a capillary pressure in the first fluidic structure is higher than a capillary pressure in the second fluidic structure such that, during the first stage, the reagent fluid flows into the first reagent storage and not into the mixer, and wherein a capillary pressure in the first reagent storage is higher than a capillary pressure in the second fluidic structure such that the reagent fluid is stationed in the supply channel and the first reagent storage, after supplying the reagent fluid and before providing the fluid sample in the sample inlet; and wherein the mixer and the first reagent storage are adapted such that a capillary pressure in the mixer is higher than the capillary pressure in the first reagent storage such that the supplied fluid sample and the stationed reagent fluid flow into the mixer.

3. The fluidic device according to claim 1, wherein the reagent inlet is adapted to accommodate a volume that is smaller than a volume of the first reagent storage and the supply channel combined.

4. The fluidic device according to claim 2, wherein the first fluidic structure is a first fluidic channel forming the coupling between the first reagent storage and the supply channel, wherein the second fluidic structure is a second fluidic channel forming the coupling between the mixer and the supply channel, and wherein a width of the first fluidic channel and the second fluidic channel are adapted such that the capillary pressure in the first fluidic channel is higher than the capillary pressure in the second fluidic channel.

5. The fluidic device according to claim 2, wherein the first fluidic structure and/or the second fluidic structure comprises pillars which are in direct contact with the fluid sample, when present in the first fluidic structure and/or the second fluidic structure, and which are arranged such that the capillary pressure in the first fluidic structure is higher than the capillary pressure in the second fluidic structure.

6. The fluidic device according to claim 1, wherein the first reagent storage and the mixer each comprise fluidic channels having widths that are adapted such that a capillary pressure in the mixer is higher than a capillary pressure in the first reagent storage.

7. The fluidic device according to claim 1, wherein the first reagent storage and/or the mixer comprise pillars arranged such that a capillary pressure in the mixer is higher than a capillary pressure in the first reagent storage.

8. The fluidic device according to claim 1, wherein all fluidic components are closed.

9. The fluidic device according to claim 1, further comprising a glass cover positioned such that at least the supply channel, the first reagent storage, and the mixer are closed.

10. The fluidic device according to claim 1, wherein all components are fabricated in a silicon wafer.

11. The fluidic device according to claim 1, wherein the fluidic device is valve-less.

12. A multi-step assay device, comprising:

the fluidic device according to claim 1;

a fluidic channel coupled to the mixer outlet;

a second reagent storage coupled to the fluidic channel via a third fluidic structure;

a third reagent storage coupled to the fluidic channel via a fourth fluidic structure;

a first fluidic component coupled to the fluidic channel in between the third fluidic structure and the fourth fluidic structure;

a second fluidic component coupled to the first fluidic component via a fifth fluidic structure; and a third fluidic component coupled to the second fluidic component via a sixth fluidic structure, wherein the multi-step assay device is adapted such that:

a capillary pressure in the third fluidic structure is higher than a capillary pressure in the fifth fluidic structure;

the capillary pressure in the fifth fluidic structure is higher than a capillary pressure in the fourth fluidic structure;

the capillary pressure in the fourth fluidic structure is higher than a capillary pressure in the sixth fluidic structure;

a capillary pressure in the second fluidic component is higher than a capillary pressure of the second reagent storage;

a capillary pressure of third fluidic component is higher than a capillary pressure in the third reagent storage.

13. A multi-step assay device for DNA analysis, comprising a multi-step assay device according to claim 12, and wherein the first fluidic component is a PCR chamber.

14. A sensing system, comprising:

the fluidic device according to claim 1;

a sensor coupled to the mixer outlet and arranged for sensing an analyte in a mixed fluid sample exiting the mixer.

15. A method for mixing the reagent fluid with the fluid sample using the fluidic device according to claim 1, comprising:

in a first stage:

providing the reagent fluid in the reagent inlet, wherein the provided reagent fluid is of a volume that is lower than a volume of the first reagent storage and the supply channel combined; thereafter allowing the reagent fluid to flow into the supply channel and the first reagent storage; and thereafter in a second stage:

providing the fluid sample in the sample inlet.

16. A diagnostic device for diagnosing a status of an object or a patient, the diagnostic device comprising the fluidic device according to claim 1; and a sensor coupled to the mixer outlet and arranged for sensing an analyte in a mixed fluid sample exiting the mixer, the sensor providing an output on which diagnosing can be based.

17. A diagnostic device for diagnosing a status of an object or a patient, the diagnostic device comprising the multi-step assay device according to claim 12; and a sensor coupled to the mixer outlet and arranged for sensing an analyte in a mixed fluid sample exiting the mixer, the sensor providing an output on which diagnosing can be based.

* * * * *